United States Patent [19]

Fujisaku

[11] Patent Number: 4,940,970

[45] Date of Patent: Jul. 10, 1990

[54] CRT DISPLAY DEVICE WITH A PICTURE-SHIFTING CIRCUIT

[75] Inventor: Kiminori Fujisaku, Inagi, Japan

[73] Assignee: Fujitsu Limited, Kawasaki, Japan

[21] Appl. No.: 346,308

[22] Filed: May 2, 1989

Related U.S. Application Data

[63] Continuation of Ser. No. 220,437, Jul. 13, 1988, abandoned, which is a continuation of Ser. No. 20,199, Feb. 27, 1987, abandoned, which is a continuation of Ser. No. 393,532, Jun. 30, 1982, abandoned.

[30] Foreign Application Priority Data

Jun. 30, 1981 [JP] Japan ..... 56-100508

[51] Int. Cl.[5] ..... G09G 1/16

[52] U.S. Cl. ..... 340/726; 340/724

[58] Field of Search ..... 340/721, 723, 724, 725, 340/726, 792

[56] References Cited

U.S. PATENT DOCUMENTS

| | | | |
|---|---|---|---|
| 4,068,225 | 1/1978 | Lee | 340/724 |
| 4,129,859 | 12/1978 | Iwamura et al. | 340/724 X |
| 4,201,983 | 5/1980 | Magerl et al. | 340/724 X |
| 4,246,578 | 1/1981 | Kawasaki et al. | 340/724 X |
| 4,249,172 | 2/1981 | Watkins et al. | 340/792 X |
| 4,342,991 | 8/1982 | Pope et al. | 340/792 X |
| 4,491,834 | 1/1985 | Oguchi | 340/723 X |
| 4,618,858 | 10/1986 | Belch | 340/721 |

*Primary Examiner*—Alvin Oberley

*Attorney, Agent, or Firm*—Staas & Halsey

[57] ABSTRACT

A CRT display device with a picture-rearranging circuit in which a display address for accessing a memory to display data stored in the memory is calculated at a high speed by hardware, i.e., a calculator, which counts values from an address counter or a reading or writing address from a microprocessing unit and an offset address generated from the microprocessing unit, the offset address being used to change the picture-arrangement on a display panel.

6 Claims, 2 Drawing Sheets

CRT DISPLAY DEVICE WITH A PICTURE-SHIFTING CIRCUIT

This is a continuation of co-pending application Ser. No. 220,437 filed on July 13, 1988 which is a cont. of Ser. No. 010,199, filed Feb. 27, 1987, abandoned; and which is a cont. of Ser. No. 393,532, filed June 30, 1982, also abandoned.

BACKGROUND OF THE INVENTION

1. Field of the Invention

The present invention relates to a cathode-ray tube (CRT) display device with a picture-shifting circuit and more particularly to a full-graphic display device with a picture shifting circuit.

A full-graphic display device is one which displays both words and pictures. It can display a great amount of visual data so that the operator can quickly respond to the data. For this reason, full-graphic display devices are widely used in picture-processing units, in electric power systems, in building-maintenance systems, in water supply systems, etc.

2. Description of the Prior Art

Generally, a full-graphic display device comprises a memory for storing data to be displayed to a CRT display panel, an address counter for cyclically and sequentially generating count values so as to access the memory, and a microprocessing unit for controlling data to be written into the memory or for editing data stored in the memory so as to display a desired picture. The CRT display panel and the memory have panel addresses and memory addresses, respectively. The number of memory addresses is greater than the number of panel addresses. The microprocessing unit generates reading or writing addresses, for writing data into or reading data out of the memory, and also generates offset addresses. The offset addresses are used for shifting the displayed picture on the display panel, so that the picture is shifted to the right, to the left, down, or diagonally. Rearrangement of the pic is necessary when, for example, a great amount of data is to be displayed in a simple way and at a high speed.

Conventionally, the offset addresses are calculated with other addresses by the address counter and by the microprocessing unit by using software. The use of software however, greatly delays the operating speed of the address for calculating the offset address with other addresses, counter or the operating speed of the microprocessing unit. Therefore, the conventional system involves problems in that shifting of the picture is carried out at a slow speed and in that the speed at which the microprocessing unit controls data to be written or read out of the memory is slow.

SUMMARY OF THE INVENTION

Accordingly, an object of the present invention is to provide a display device having a picture-shifting circuit in which the speed at which the picture is shifted is increased.

Another object of the present invention is to provide such a device as mentioned above in which the speed at which the microprocessing unit controls data to be written into or read out of the memory, is increased.

In order to achieve the above objects, according to the present invention, there is provided a display device having a picture-shifting circuit and comprising: a memory, having memory addresses, for storing data therein; a CRT display panel, having panel addresses, for displaying pictures corresponding to the data stored in the memory; a processor unit for generating writing or reading addresses and offset addresses for shifting the picture displayed on the CRT display panel; an address counter for cyclically and sequentially generating count values; and a calculating circuit for calculating virtual addresses for accessing the memory based on the count values, the writing or the reading addresses and the offset addresses.

The advantages of the present invention are such that the address counter and the microprocessing unit need not calculate the offset address with other addresses. Therefore, as described later in detail, the processing time is greatly shortened.

BRIEF DESCRIPTION OF THE DRAWINGS

The above objects and advantages, as well as the characteristic features of the present invention, will be better understood from the following detailed description with reference to the accompanying drawings, wherein.

DESCRIPTION OF THE PREFERRED EMBODIMENT

Before describing the embodiment, the principle of shifting the displayed picture will first be explained with reference to FIG. 1, which is a diagram of a general example of shifting the displayed picture. In the figure, M represents a memory and D represents a CRT display panel. Hereinafter, all addresses are expressed in hexadecimals. Memory M, in this example, has a memory area ranging from address 0000 to address 2FFF. In memory M, data X is stored between address 0000 and address 0FFF; data Y is stored between address 1000 and 1FFF; and data Z is stored between address 2000 and address 2FFF. The CRT display panel D in this example has panel addresses ranging from address 0000 to address 1FFF.

Figure 1:
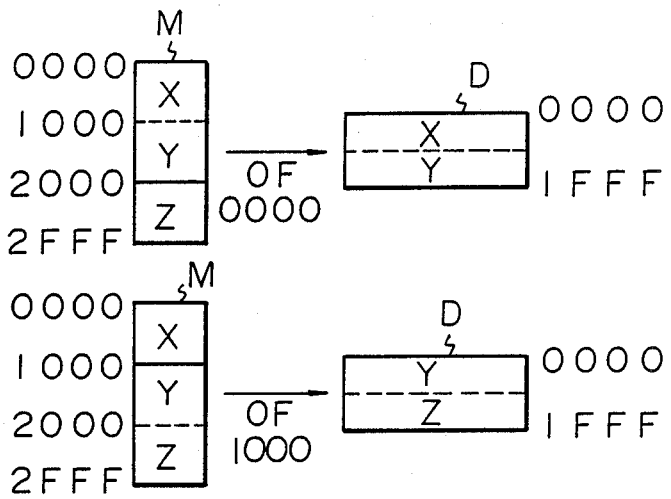
FIG. 1 is a diagram of a general example of the shifting of a displayed picture.

When an offset address OF=0000 is generated by a microprocessing unit (not shown in FIG. 1), the picture is not shifted, and, as illustrated in the upper part of FIG. 1, data X and Y stored in the memory area between address 0000 and address 1FFF are displayed. In contrast, when an offset address 1000 is generated by the microprocessing unit, the picture is shifted upwards, as illustrated in the lower part of FIG. 1, and data Y and Z stored in the memory area between address 1000 and 2FFF is displayed.

Figure 2:
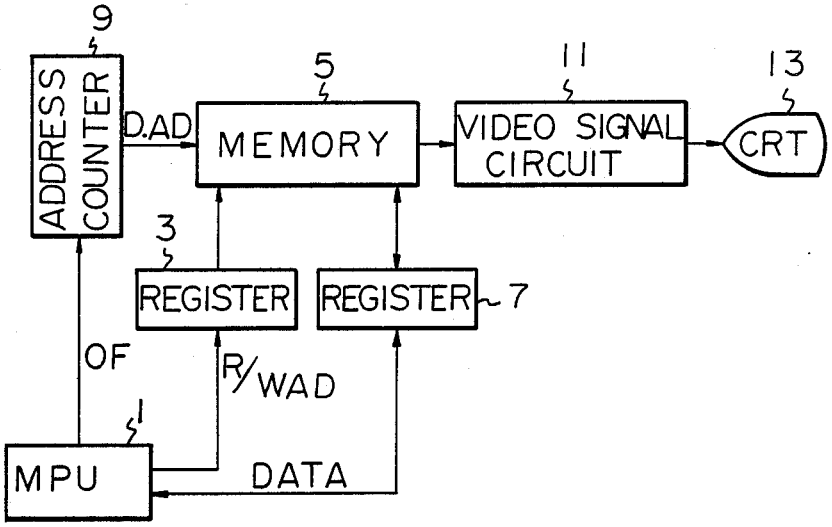
FIG. 2 is a block circuit diagram of a main portion of a conventional CRT display device with a picture-shifting circuit.

Conventionally, the shifting of the picture has been effected by using software. This conventional technique will be described with reference to FIG. 2. FIG. 2 is a block circuit diagram of a main portion of a conventional CRT display device having a picture-shifting circuit. In the figure, 1 is a microprocessing unit for generating reading or writing addresses R/W AD and offset addresses OF and for processing data; 3 is an address register for temporarily storing the reading or writing addresses generated by microprocessing unit 1; 5 is a memory for storing data to be displayed; 7 is a data register for temporarily storing data output from the microprocessing unit 1 or data read out of memory 5; 9 is an address counter for sequentially and cyclically generating display addresses; 11 is a video signal-generating circuit for converting data, read out of memory 5 by accessing the memory 5 by the display addresses from address counter 9, into video signals; and 13 is a CRT display unit. It is assumed that the CRT display unit 13 has the same panel addresses ranging from address 0000 to address 1FFF as in FIG. 1. Also, it is assumed that memory 5 has the same addresses ranging from address 0000 to address 2FFF as in FIG. 1. The number of display addresses generated during one cycle of address counter 9 is the same as the number of panel addresses, i.e., 1FFF. Each cycle of address counter 9 is synchronous with one vertical synchronizing signal of the CRT display unit 13.

In a display operation when microprocessing unit 1 generates offset address 0000 to address counter 9, address counter 9 sequentially and cyclically generates display addresses from address 0000 to address 1FFF. These display addresses are the same as the count values originally generated by address counter 9. Thus, data stored in memory addresses 0000 to 1FFF is displayed.

In a display operation when microprocessing unit 1 generates offset address 1000, address counter 9 sequentially and cylically generates display addresses from 1000 to 2FFF. Thus, in this case, data stored in memory addresses ranging from 1000 to 2FFF is displayed on panel addresses ranging from 0000 to 1FFF, respectively. Therefore, the picture is shifted upwards on the display panel by address 1000. In this case, the offset address is added to the count value originally generated by address counter 9 by software. This addition by software takes a long time, and, therefore, there is a disadvantage in that a long time is required to shift the picture.

During a display operation, the displayed pictures or words often must be rewritten. When there is no offset during a display operation, no problem occurs in rewriting. However, when there is an offset during a display operation, the rewriting operation takes a long time due to the software. More precisely, when data displayed at a panel address of, for example, 1001 is to be rewritten during a display operation in which the offset address is 1000, microprocessing unit 1 generates a reading address of 1001+1000=2001 by using software. By accessing memory 5 with reading address 2001, data stored in memory address 2001 in memory 5 is read to data register 7. Microprocessing unit 1 receives data from data register 7 and processes the read data to generate new data to be rewritten. Then microprocessing unit 1 generates a writing address of 2001 and stores the new data in memory address 2001 of memory 5. Thus, the data displayed at a panel address of 1001 is rewritten. The generation of a reading or writing address is effected in microprocessing unit 1 by software. Therefore, a rewriting operation in which there is an offset takes a long time.

Figure 3:
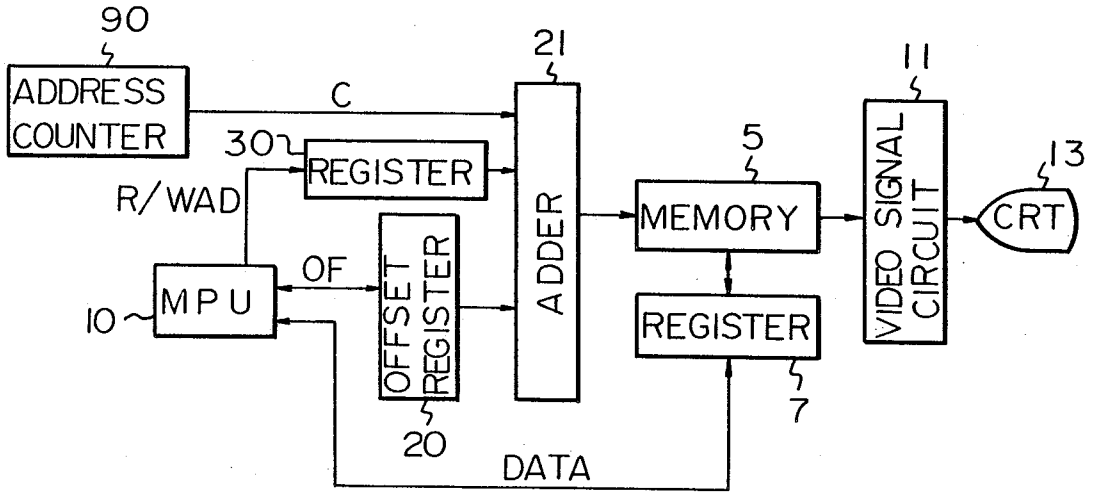
FIG. 3 is a block circuit diagram of a main portion of a CRT display device having a picture-shifting circuit, according to an embodiment of the present invention.

An embodiment of the present invention will now be described with reference to FIG. 3. FIG. 3 is a block circuit diagram of a main portion of a CRT display device with a picture shifting circuit, according to the embodiment of the present invention. In the figure, 10 is a microprocessing unit for generating reading or writing addresses R/W AD and offset addresses OF and for processing data; 20 is an offset register for temporarily storing an offset address from microprocessing unit 10; 21 is an adder; 30 is an address register for temporarily storing a reading or writing address from microprocessing unit 10; and 90 is an address counter for sequentially and cyclically generating count values C. Memory 5, data register 7, video signal-generating circuit 11, and CRT display unit 13 are the same as those in the conventional device of FIG. 2. Adder 21 receives a reading or writing address R/W AD from address register 30, a count value C from address counter 90, and an offset address OF from offset register 20. It is assumed that the CRT display unit 13 has panel addresses ranging from address 0000 to address 1FFF and that memory 5 has memory addresses ranging from address 0000 to address 2FFF. Address counter 90 sequentially and cyclically generates count values from 0000 to 1FFF. Each cycle of address counter 90 is synchronous with one vertical synchronizing signal of the CRT display unit 13.

Display operations in which there is no offset are the same as those in the conventional device.

In a display operation in which there is an offset address of 1000, microprocessing unit 10 generates offset address 1000 to offset register 20. Adder 21 adds each count value from address counter 90 and offset value 1000 from offset register 20 to form a virtual address, i.e., a display address for accessing memory 5. Adder 21, therefore, generates virtual addresses from 1000 to 2FFF in this case. Thus, data stored in memory addresses ranging from 1000 to 2FFFis displayed on panel addresses from 0000 to 1FFF, respectively. As a result, the picture is shifted on the display panel by address 1000. Since the display addresses, are not obtained in address counter 90 by using software but instead are obtained in adder 21 by means of hardware, the time required for addition of the offset address is greatly shortened in comparison with that in the conventional device. Microprocessing unit 10 need not control address counter 90 since software in address counter 90 is unnecessary.

Further, even during a display operation having offset address 1000 and even when data displayed at a panel address of, for example, 1001 is to be rewritten, microprocessing unit 10 need not generate a reading address of 1001+1000=2001 as in the conventional device. Rather, microprocessing unit 10 generates reading address 1001 exactly corresponding to the panel address to be rewritten. Adder 21 adds reading address 1001 from address register 30 and offset address 1000 from offset register 20 so as to form a virtual address, i.e., new reading address 2001. Memory 5 is accessed by new reading address 2001 so that data stored in memory address 2001 is read into data register 7. Microprocessing unit 10 receives data from data register 7 and processes the read data so as to generate new data to be rewritten. Then microprocessing unit 10 generates a writing address 1001 exactly corresponding to the panel address to be rewritten. Adder 21 again adds writing address 1001 and offset address 1000 so as to form a virtual address, i.e., new writing address 2001. Thus, data stored in memory address 2001 is rewritten. The rewritten data is displayed at display address 1001 of display unit 13. Since microprocessing unit 10 need not calculate the new reading or writing address, the time required for the rewriting operation is also greatly shortened in comparison with the processing time in the conventional device.

The present invention is not limited to the foregoing description of the embodiment. For example, any number of panel addresses in the CRT display unit 13 or any number of memory addresses in the memory 5 is possible in the present invention. Also, any type of calculating circuit may be substituted for adder 21. By using an appropriate calculating circuit, the picture on the display panel can be shifted not only up or down but also right wards or left and diagonally.

From the foregoing description, it will be apparent that, according to the present invention, since a display address or a writing address is calculated by hardware, the speed at which the picture is shifted and the speed at which the rewriting operation is effected is greatly increased.

I claim:

1. A CRT display device with a picture shifting circuit, comprising:

a memory, having memory addresses, for storing data therein;

a CRT display panel, operatively connected to said memory, for displaying pictures corresponding to data stored in said memory;

a processor unit, operatively connected to said memory, for generating writing addresses to write data from said processor unit into said memory and for generating reading addresses to read data from said memory to said processor unit;

storing means operatively connected to said processor unit for storing an offset address;

an address counter, for generating count values specifying a part of the address space of said memory, cyclically and sequentially; and a calculating circuit, operatively connected to said processor unit, said storing means, said address counter, and said memory, for receiving the writing and reading addresses from said processor unit, the offset address from said storing means, and the count values from said address counter and responsive to said writing and reading addresses generated by said processor unit, said offset address stored in said storing means and said count values generated by said address counter and performing a logical operation with respect to the offset address and one of the writing and reading addresses, for supplying real addresses obtained through said logical operation during a display operation for accessing said memory in accordance with the count values and said offset address, and for supplying real addresses obtained through said logical operation for accessing said memory during one of a read and write operation in accordance with said one of said writing addresses and reading addresses from said processor unit and said offset address.

2. A CRT display device as set forth in claim 1, wherein said calculating circuit comprises an adder.

3. A CRT display device having a memory with addresses for storing data and having a CRT display panel for displaying pictures corresponding to data read out from said memory, comprising:

a processor unit, operatively connected to the CRT display panel, for generating read addresses, to read data from the memory to said processor unit, and for generating write addresses, to write data from said processor unit to the memory storing means, operatively connected to said processor unit, for storing an offset address;

an address counter, for generating count values specifying a part of an address space of the memory, cyclically and sequentially;

a calculating circuit, operatively connected to the memory, said address counter, said processor unit, and said storing means, for receiving the read and write addresses from said processor unit, the count values from said address counter, the addresses from the memory and the offset address from said storing means, and responsive to said read and write addresses generated by said processor unit, said offset address stored in said storing means and said count values generated by said address counter, and performing a logical operation with respect to the offset address and the count values and a logical operation with respect to the offset address and one of the write and read addresses, for generating addresses obtained through said logical operation during a display operation to access the memory in accordance with count values and said offset address, and for calculating real addresses obtained through said logical operation for accessing the memory during one of a read and write operation in accordance with the reading and writing addresses from said processor unit and said offset address.

4. A CRT display device as set forth in claim 3, wherein said calculating circuit comprises an adder for adding the count values and the selected one of the read addresses and the write addresses, to the offset addresses.

5. A CRT display device including a picture display circuit, comprising:

a processor unit for generating reading addresses to read data into said processor unit, and for generating writing addresses to write data from said processor unit, and offset addresses;

address counter means for cyclically and sequentially generating count values corresponding to addresses designating a location on the picture display and for accessing data corresponding to each picture plane;

address register means, operatively connected to said processor unit, for storing said reading and writing addresses from said processor unit;

offset register means, operatively connected to said processor unit, for storing said offset addresses from said processor unit;

calculating means, operatively connected to said address counter means, said address register means, and said offset register means, responsive to said writing and reading addresses generated by said processor unit, said offset addresses stored in said address register means and said count values generated by said address counter means, performing a logical operation with respect to the offset addresses and the count values and performing a logical operation with respect to the offset addresses and one of the reading and writing addresses, for adding, during a display operation, a count value from said address counter means and said offset address stored in said offset storing register means and obtaining a display address, and for adding, during one of a reading and writing operation, one of said reading and writing addresses stored in said address register means and said offset address from said offset register means and obtaining a new one of said reading and writing addresses;

memory means, operatively connected to said calculating means, for receiving one of said display address and said new one of said reading and writing addresses obtained by said logical operations, for accessing said memory means and for defining an address space having a portion specified by said address counter means; and a CRT display panel, operatively connected to said memory means, for displaying pictures corresponding data output from said memory means.

6. A display controller for picture shifting, connectable to a memory having memory addresses for storing data therein, displaying means for providing a picture, the display means, upon receipt of addresses from the memory means for designating a location on the display means, for displaying pictures corresponding to data stored in the memory, and a processor unit, operatively connected to the memory, for generating writing addresses to write data from the processor unit into the memory, and for generating reading addresses to read data from the memory to the processor unit, as addresses for the display mans, the writing and reading addresses being in one-to-one correspondence with the addresses for the display means and exactly corresponding to the picture displayed on the display means, the display controller comprising:

storing means, operatively connected to the processor unit, for storing an offset address for shifting the addresses of the display means;

an address counter for cyclically and sequentially generating count values specifying a part of an address space of the memory corresponding to the addresses for the display means for accessing data corresponding to each one of a picture plane; and a calculating circuit, operatively connected to the processor unit, the storing means, the address counter, and the memory, for receiving the address from the processor unit, the offset address from the storing means, and the count values from said address counter, responsive to the writing and reading addresses generated by the processor unit, the offset address stored in the storing means, and the count values generated by said address counter, performing a logical operation with respect to the offset address and the count values and performing a logical operation with respect to the offset address and one of the writing and reading addresses, for supplying real addresses obtained through the logical operation during a display operation for accessing the memory in accordance with the count values and the offset address, and for supplying real addresses obtained through the logical operation for accessing the memory during one of a read and write operation in accordance with one of the writing addresses and reading addresses from the processor unit and the offset address.

* * * * *

UNITED STATES PATENT AND TRADEMARK OFFICE

CERTIFICATE OF CORRECTION

PATENT NO. : 4,940,970

DATED : July 10, 1990

INVENTOR(S) : Kiminori FUJISAKU

It is certified that error appears in the above-identified patent and that said Letters Patent is hereby corrected as shown below:

Col. 1, line 39, "pic" should be --picture--;
line 45, "software however" should be --software for calculating the offset address with other addresses, however--;
line 46, "for calculating the offset address with other" should be deleted;
line 47, "addresses," should be deleted;
line 51, "written or" should be --written into or--.

Col. 2, line 39, "decimals." should be --decimal.--.

Col. 5, line 61, "memory" should be --memory;--.

Signed and Sealed this

Twentieth Day of August, 1991

*Attest:*

*Attesting Officer*

HARRY F. MANBECK, JR.

*Commissioner of Patents and Trademarks*